US012025308B1

(12) United States Patent
Guo

(10) Patent No.: US 12,025,308 B1
(45) Date of Patent: Jul. 2, 2024

(54) COMBUSTION FURNACE WITH ADJUSTABLE FIREPOWER

(71) Applicant: Ninghao Guo, Ningbo (CN)

(72) Inventor: Ninghao Guo, Ningbo (CN)

( * ) Notice: Subject to any disclaimer, the term of this patent is extended or adjusted under 35 U.S.C. 154(b) by 0 days.

(21) Appl. No.: 18/171,253

(22) Filed: Feb. 17, 2023

(30) Foreign Application Priority Data

Jan. 19, 2023 (CN) ..... 202320181226.0

(51) Int. Cl.
*F23M 9/02* (2006.01)
*F23M 20/00* (2014.01)

(52) U.S. Cl.
CPC ..... *F23M 9/02* (2013.01); *F23M 20/00* (2015.01); *F23M 2900/09061* (2013.01)

(58) Field of Classification Search
CPC . F23M 9/02; F23M 20/00; F23M 2900/09061
See application file for complete search history.

(56) References Cited

U.S. PATENT DOCUMENTS 105,672 A * 7/1870 Hackett ..... F24B 5/026 126/77
1,200,577 A * 10/1916 Berkheimer ..... F24B 5/026 126/77
3,051,159 A * 8/1962 Hardy ..... A47J 33/00 126/77
5,024,208 A * 6/1991 Hottenroth ..... A47J 37/0763 126/25 R
6,314,955 B1 * 11/2001 Boetcker ..... A47J 36/2477 126/38
2018/0116453 A1 * 5/2018 Boyd, Sr. ..... A47J 37/0704
2020/0096199 A1 * 3/2020 Harrington ..... F24B 5/025

FOREIGN PATENT DOCUMENTS

CN 107166442 A * 9/2017
DE 202007011036 U1 * 11/2007 ..... F24B 1/202
FR 900525 A * 7/1945
KR 880001769 Y1 * 5/1988
KR 20150133109 A * 11/2015

* cited by examiner

*Primary Examiner* — Jorge A Pereiro
*Assistant Examiner* — Logan P Jones

(57) ABSTRACT

The present disclosure provides a combustion furnace with adjustable firepower, including a furnace body. The furnace body is provided with a combustion chamber in which combustible materials are placed. The furnace body further includes an adjusting mechanism and an air inlet, the air inlet is provided on the side wall of the furnace body, and communicated with the combustion chamber so that external air enters the combustion chamber through the air inlet. The adjusting mechanism is configured to control the air inlet to be turned on or off. Through the above structural arrangement, users can control the air inlet to be turned on or off by controlling the adjusting mechanism, so as to adjust the firepower of the combustion furnace.

1 Claim, 17 Drawing Sheets

COMBUSTION FURNACE WITH ADJUSTABLE FIREPOWER

CROSS-REFERENCE TO RELATED APPLICATIONS

The application claims priority of Chinese patent application CN202320181226.0, filed on Jan. 19, 2023, which is incorporated herein by reference in its entireties.

TECHNICAL FIELD

The present disclosure relates to the technical field of combustion furnace devices, in particular to a combustion furnace with adjustable firepower.

BACKGROUND

With the gradual improvement of people's living standards, outdoor sports are becoming more and more popular in people's lives. In outdoor sports, such as mountaineering, exploration and long-distance travel, picnics are often indispensable, and a combustion furnace is usually used in the process of picnics. However, the existing combustion furnace is relatively simple in structure, and it is difficult to adjust the firepower and adapt to different application scenarios.

SUMMARY

In order to solve the above technical problem, the present disclosure provides a combustion furnace with adjustable firepower, including a furnace body, wherein the furnace body is provided with a combustion chamber in which combustible materials are placed, wherein the furnace body further includes an adjusting mechanism and an air inlet, the air inlet is provided on the side wall of the furnace body, and communicated with the combustion chamber so that external air enters the combustion chamber through the air inlet, and the adjusting mechanism is configured to control the air inlet to be turned on or off.

Further, the air inlet is provided at the bottom of the side wall of the furnace body, the adjusting mechanism includes a baffle, and the baffle is provided at the bottom of the furnace body and closely clings to the side wall of the furnace body to turn off the air inlet.

Further, the baffle is configured to rotate coaxially with respect to the furnace body, an open-hole is provided on the baffle, and when the baffle rotates axially relative to the furnace body, the open-hole can overlaps with the air inlet to turn on the air inlet.

Further, the adjusting mechanism further includes a hand-held part, one side of the hand-held part extends out of a connecting part, the bottom of the side wall of the furnace body is transversely provided with a sliding groove, and the connecting part is connected with the baffle through the sliding groove.

Further, a combustion rack in which combustible materials are placed is provided in the combustion chamber, the combustion chamber forms a lower chamber below the combustion rack, a plurality of wind shields are provided in the lower chamber to divide the lower chamber into a plurality of chamber units, and the combustion rack is erected on the top of the wind shields.

Further, a storage rack is further provided in the combustion chamber, the storage rack is provided below the combustion rack, and the combustion rack is provided with a plurality of through-holes, so that the ashes after burning combustible materials fall into the storage rack through the through-holes.

Further, the furnace body includes a first furnace body unit and a second furnace body unit, and the second furnace body unit is provided in the first furnace body unit; the bottom wall of the second furnace body unit is higher than the bottom wall of the first furnace body unit to form a second air passage between the bottom wall of the first furnace body unit and the bottom wall of the second furnace body unit; the air inlet is provided at the bottom of the side wall of the first furnace body unit, the combustion chamber is provided in the second furnace body unit, and the bottom wall of the second furnace body unit is provided with an opening to realize the communication between the combustion chamber and the second air passage.

Further, the baffle is provided at the bottom of the first furnace body unit and closely clings to the first furnace body unit, and the sliding groove is provided on the side wall of the first furnace body unit.

Further, the inner diameter of the second furnace body unit is smaller than the inner diameter of the first furnace body unit to form a first air passage between the side wall of the first furnace body unit and the side wall of the second furnace body unit; the combustion chamber forms an upper chamber above the combustion rack, the side wall of the upper chamber is provided with an air outlet, and air enters the first air passage through the air inlet and then enters the upper chamber through the air outlet.

Further, the combustion furnace with adjustable firepower further includes a base, and the base is provided below the furnace body for supporting the furnace body.

The present disclosure also provides a combustion furnace with adjustable firepower, including a furnace body, the furnace body provided with a combustion chamber in which combustible materials are placed, the furnace body further including a baffle and an air inlet, the air inlet provided on a side wall of the furnace body, the air inlet communicated with the combustion chamber so that external air enters the combustion chamber through the air inlet, wherein the baffle is controlled to turn on the air inlet to increase firepower of the combustible materials and the baffle is controlled to turn off the air inlet to decrease the firepower of the combustible materials.

Further, the air inlet is provided at the bottom of the side wall of the furnace body, and the baffle is provided at the air inlet and closely clings to the side wall of the furnace body to turn off the air inlet.

Further, the baffle is configured to rotate coaxially with respect to the furnace body, an open-hole is provided on the baffle, and the baffle is rotated so that the open-hole overlaps with the air inlet to turn on the air inlet.

Further, the combustion furnace with adjustable firepower further includes a hand-held part, one side of the hand-held part extends out of a connecting part, the bottom of the side wall of the furnace body is transversely provided with a sliding groove, and the connecting part is connected with the baffle through the sliding groove.

Further, a combustion rack in which combustible materials are placed is provided in the combustion chamber, the combustion chamber forms a lower chamber below the combustion rack, a plurality of wind shields are provided in the lower chamber to divide the lower chamber into a plurality of chamber units, and the combustion rack is erected on the top of the wind shields.

Further, a storage rack is further provided in the combustion chamber, the storage rack is provided below the combustion rack, and the combustion rack is provided with a plurality of through-holes, so that the ashes after burning combustible materials fall into the storage rack through the through-holes.

Further, the furnace body includes a first furnace body unit and a second furnace body unit, and the second furnace body unit is provided in the first furnace body unit; the bottom wall of the second furnace body unit is higher than the bottom wall of the first furnace body unit to form a second air passage between the bottom wall of the first furnace body unit and the bottom wall of the second furnace body unit; the air inlet is provided at the bottom of the side wall of the first furnace body unit, the combustion chamber is provided in the second furnace body unit, and the bottom wall of the second furnace body unit is provided with an opening to realize the communication between the combustion chamber and the second air passage.

Further, the baffle is provided at the bottom of the first furnace body unit and closely clings to the first furnace body unit, and the sliding groove is provided on the side wall of the first furnace body unit.

Further, the inner diameter of the second furnace body unit is smaller than the inner diameter of the first furnace body unit to form a first air passage between the side wall of the first furnace body unit and the side wall of the second furnace body unit; the combustion chamber forms an upper chamber above the combustion rack, the side wall of the upper chamber is provided with an air outlet, and air enters the first air passage through the air inlet and then enters the upper chamber through the air outlet.

Further, the combustion furnace with adjustable firepower further includes a base, and the base is provided below the furnace body for supporting the furnace body.

Beneficial effects: the combustion furnace with adjustable firepower according to the present disclosure is provided with an adjusting mechanism or a baffle and an air inlet, and the air inlet is provided on the side wall of the furnace body and is communicated with the combustion chamber, so that external air enters the combustion chamber through the air inlet, and the adjusting mechanism or baffle is configured to control the air inlet to be turned on or off.

Through the above structural arrangement, when the firepower needs to be increased, the adjusting mechanism can be controlled to turn on the air inlet. After the air inlet is turned on, oxygen in the combustion chamber is continuously consumed along with the combustion of combustible materials, so that the external air enters the combustion chamber through the air inlet, and the combustion of combustible materials is stronger. When the firepower needs to be decreased, the adjusting mechanism can be controlled to turn off the air inlet. After the air inlet is turned off, the combustion intensity of combustible materials will be gradually weakened along with the continuous consumption of oxygen in the combustion chamber, so as to prolong the combustion time of combustible materials. Through the above structural arrangement, users can adjust the firepower of the combustion furnace by controlling the adjusting mechanism, so as to meet different requirements. The combustion furnace with adjustable firepower is simple in operation and strong in practicality.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
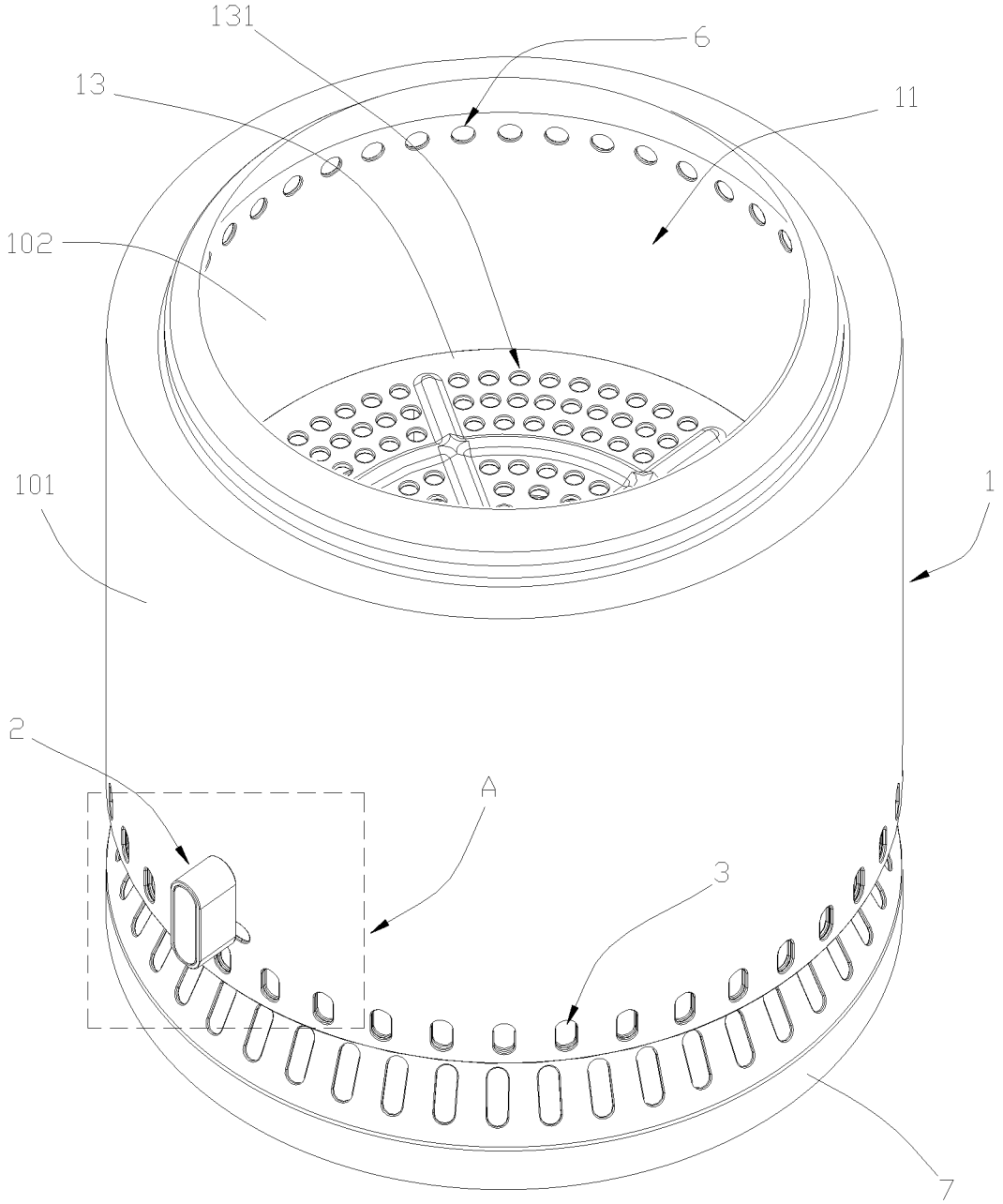
FIG. 1 shows a perspective diagram of a combustion furnace according to Embodiment 1.
Figure 2:
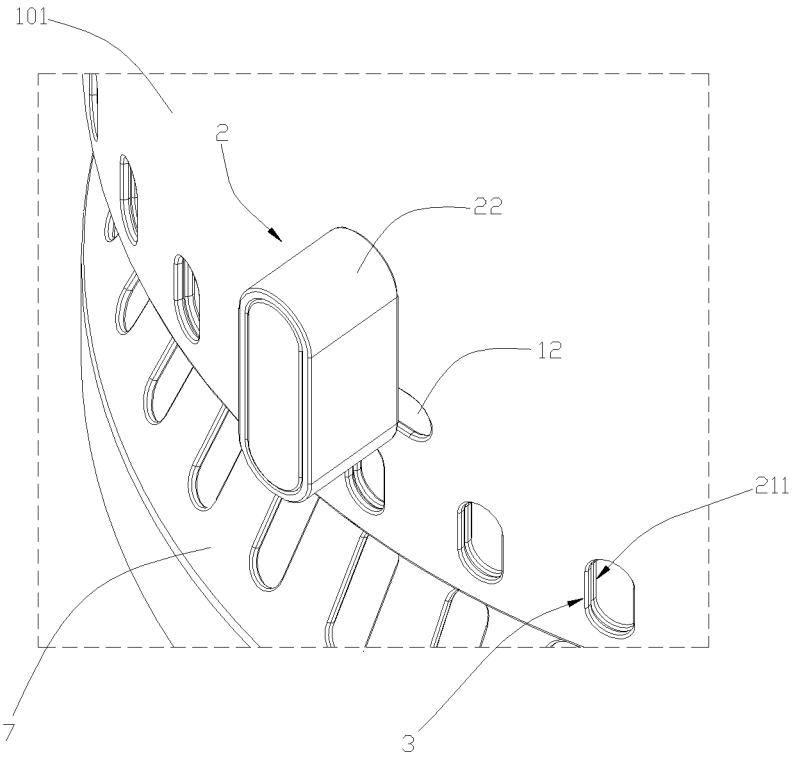
FIG. 2 shows a partial enlarged diagram at A, in which an air inlet is in an ON state.
Figure 3:
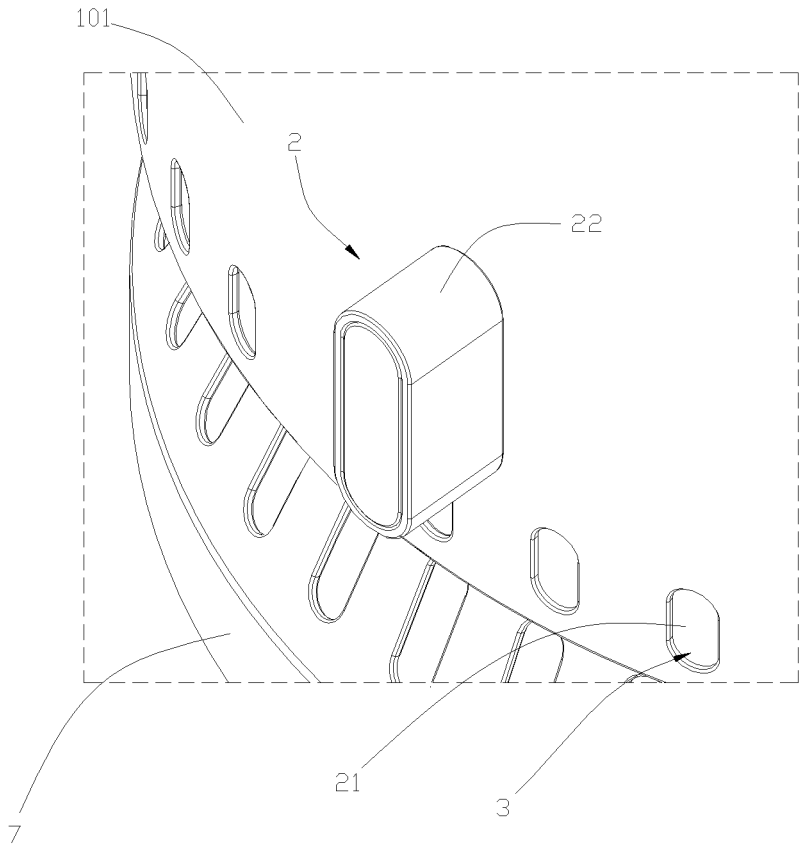
FIG. 3 shows a schematic diagram of an air inlet of FIG. 2 in an OFF state.
Figure 4:
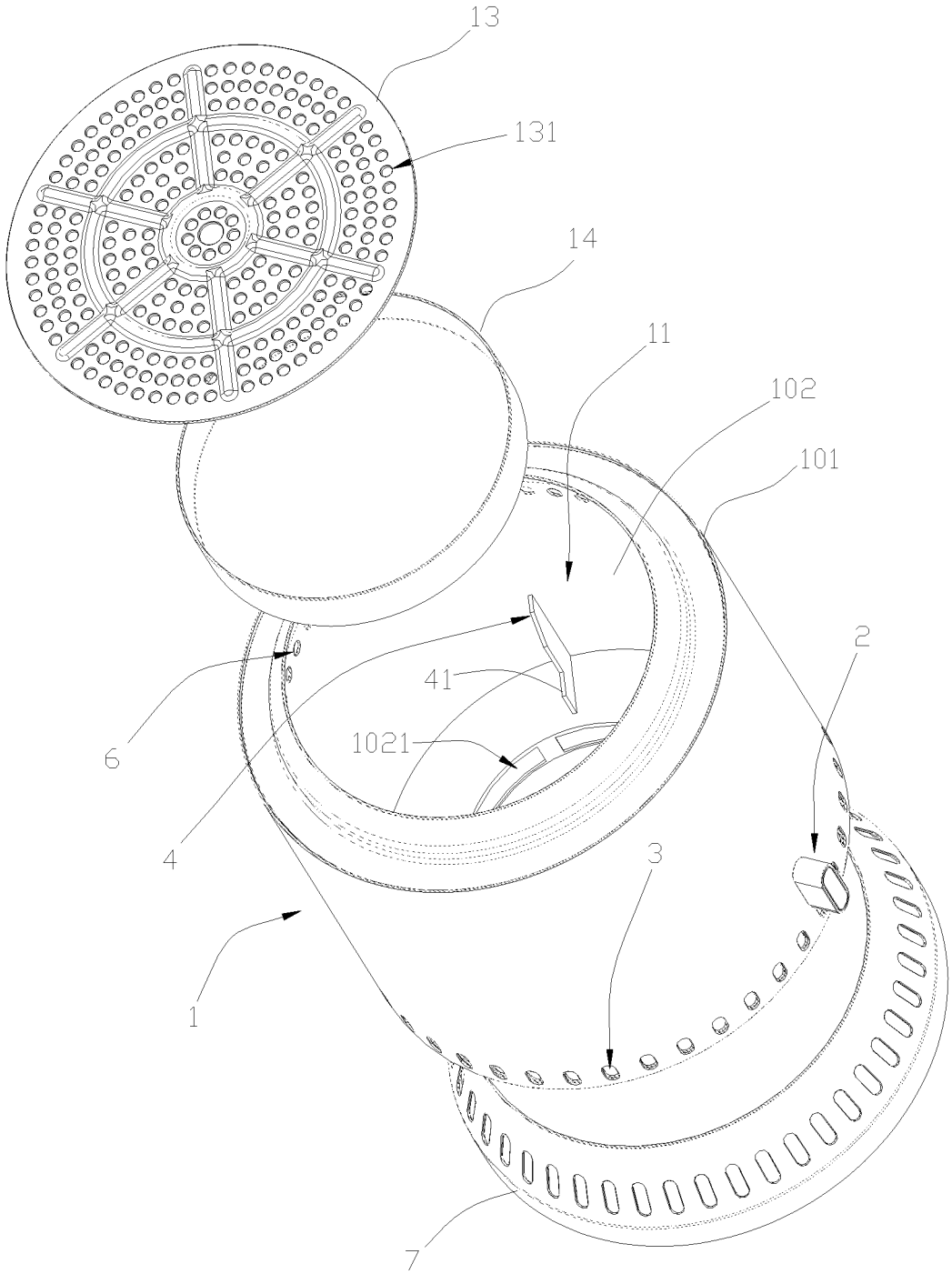
FIG. 4 shows an explosive diagram of a combustion furnace according to Embodiment 1.

It is to be noted that embodiments in the present disclosure and features in the embodiments may be combined with each other without conflict.

In the description of the present disclosure, It is to be understood that, The terms “center”, “longitudinal”, “transverse”, “upper”, “lower”, “front”, “rear”, “left”, “right”, “vertical”, “horizontal”, “top”, “bottom”, “inner”, “outer”, “clockwise”, and the like indicate azimuth or positional relationships based on the azimuth or positional relationships shown in the drawings, For purposes of convenience only of describing the present disclosure and simplifying the description, Rather than indicating or implying that the indicated device or element must have a particular orientation, be constructed and operated in a particular orientation, therefore, not to be construed as limiting the present disclosure; in addition, The terms “first” and “second” are used for descriptive purposes only, While not to be construed as indicating or implying relative importance or implicitly specifying the number of technical features indicated thereby, features defining “first,” “second,” and “second”

may explicitly or implicitly include one or more of the described features. In the description of the present disclosure, "multiple" means two or more unless explicitly specified otherwise.

In the description of the present disclosure, it is to be noted that unless otherwise expressly specified and defined, the terms "mounted", "connected", and "connected" are to be construed broadly, for example, as either a fixed connection, or a detachable connection, or an integral connection, either a mechanical connection, or an electrical connection. The specific meaning of the above term in the present disclosure will be understood by those of ordinary skill in the art depending on the particular circumstances, either directly or indirectly via an intermediate medium, communication between the two elements, or interaction between the two elements.

The specific embodiments of the present disclosure are described in details in combination with the drawings.

Embodiment 1

As shown in FIG. 1 to FIG. 7, this embodiment provides a combustion furnace with adjustable firepower. The combustion furnace includes a cylindrical furnace body 1. The furnace body 1 is provided with a combustion chamber 11 in which other combustible materials such as wood are placed. The combustion chamber 11 forms a port above the furnace body 1, into which wood is put. Further, a plurality of air inlets 3 are provided below the side wall of the furnace body 1. The air inlets 3 are provided around the furnace body 1 and are configured to be communicated with the combustion chamber 11. When wood burns in the combustion chamber 11, air can enter the combustion chamber 11 through the air inlets 3, so that the wood can be fully burned. Further, the combustion furnace of this embodiment is further provided with an adjusting mechanism 2. The adjusting mechanism 2 is configured to control the air inlets 3 to be turned on or off.

Figure 5:
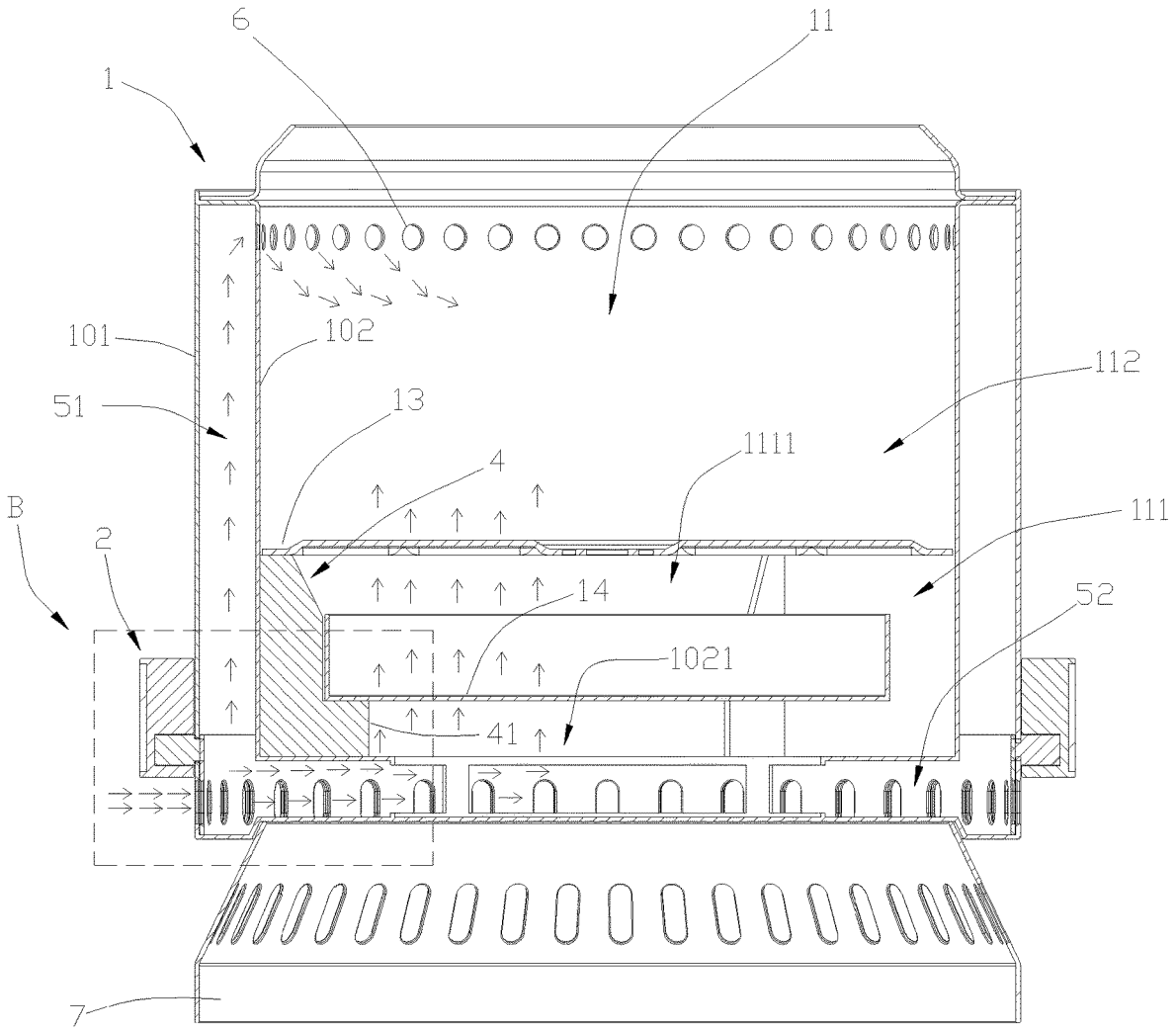
FIG. 5 shows a cross-sectional diagram of a combustion furnace according to Embodiment 1 (the arrow in the figure indicates the air flow direction).

When in use, users can put the wood into the combustion chamber 11 through the opening 1021 to ignite the wood. When the firepower needs to be increased, the adjusting mechanism 2 can be controlled to turn on the air inlet 3. As shown in FIG. 5, after the air inlet 3 is turned on, oxygen in the combustion chamber 11 is continuously consumed along with the combustion of the wood, so that the external air enters the combustion chamber 11 through the air inlet 3, and the combustion of the wood is stronger. When the firepower needs to be decreased, the adjusting mechanism 2 can be controlled to turn off the air inlet 3. After the air inlet 3 is turned off, the combustion intensity of wood will be gradually weakened along with the continuous consumption of oxygen in the combustion chamber 11, so as to prolong the combustion time of wood. Through the above structural arrangement, users can adjust the firepower of the combustion furnace by controlling the adjusting mechanism 2, so as to meet different requirements. The combustion furnace with adjustable firepower is simple in operation and strong in practicality.

Specifically, the adjusting mechanism 2 of this embodiment includes a baffle 21. The shape of the baffle 21 matches the shape of the furnace body 1. The baffle 21 is provided at the bottom of the furnace body 1 and closely clings to the side wall of the furnace body 1, and is configured to rotate coaxially with respect to the furnace body 1. Further, the baffle 21 is further provided with a plurality of open-holes 211.

Through the above structural arrangement, when the firepower needs to be adjusted to the maximum, the baffle 21 can be rotated so that the air inlet 3 of the baffle 21 overlaps with the air inlet 3 of the furnace body 1, so as to turn on the air inlet 3 of the furnace body 1. When the firepower needs to be decreased, the baffle 21 can also be rotated. When the baffle 21 is rotated, the air inlet 3 of the furnace body 1 will be gradually blocked by the rotating baffle 21, so as to turn off the air inlet 3 of the furnace body 1. The combustion furnace with adjustable firepower is simple in structure and ingenious in design.

Further, the adjusting mechanism 2 of this embodiment further includes a hand-held part 22. One side of the hand-held part 22 extends outward to form a cylindrical projection, so as to form a connecting part 23. The bottom of the side wall of the furnace body 1 is transversely provided with a sliding groove 12 matched with the connecting part 23, and the connecting part 23 is connected with the baffle 21 through the sliding groove 12.

With the above structural arrangement, when the baffle 21 needs to be rotated, the hand-held part 22 can be pushed clockwise or counterclockwise around the furnace body 1 so that the connecting part 23 translates in the sliding groove 12. The translated connecting part 23 will drive the baffle 21 to rotate in the furnace body 1, so as to realize the stepless adjustment of the baffle 21.

Further, a combustion rack 13 in which wood is placed is provided in the combustion chamber 11 of this embodiment. The combustion chamber 11 forms a lower chamber 111 below the combustion rack 13. A plurality of wind shields 4 are provided in the lower chamber 111 to divide the lower chamber 111 into a plurality of chamber units 1111. The combustion rack 13 can be erected on the top of the wind shields 4.

Through the above structural arrangement, when air enters the lower chamber 111 from the air inlet 3 at the bottom of the furnace body 1, air will enter different chamber units 1111, so as to prevent air from forming cyclone turbulence in the lower chamber 111 and improve the combustion efficiency of wood.

Further, a storage rack 14 is further provided in the furnace body 1 of this embodiment. The storage rack 14 is provided below the combustion rack 13, and the combustion rack 13 is provided with a plurality of through-holes 131. As an embodiment, the bottom of the wind shield 4 is provided with a protrusion 41. The storage rack 14 can be erected on the protrusion 41. Through the above structural arrangement, when the wood burns to form ashes, the ashes will fall into the storage rack 14 through the through-holes 131, which is convenient for storage and cleaning.

Further, the furnace body 1 of this embodiment includes a first furnace body unit 101 and a second furnace body unit 102. The second furnace body unit is provided in the first furnace body unit 101. Specifically, in this embodiment, the air inlet 3 is provided at the bottom of the side wall of the first furnace body unit 101. The combustion chamber 11 is provided in the second furnace body unit 102. The diameter of the first furnace body unit 101 is longer than that of the second furnace body unit 102. The bottom wall of the second furnace body unit 102 is higher than the bottom wall of the first furnace body unit 101 to form a first air passage 51 between the side wall of the second furnace body unit 102 and the side wall of the first furnace body unit 101, and form a second air passage 52 between the bottom wall of the first furnace body unit 101 and the bottom wall of the second furnace body unit 102. Further, the bottom wall of the second furnace body unit 102 is provided with an opening 1021 to realize the communication between the combustion chamber 11 and the second air passage 52.

With the above structural arrangement, when wood burns in the combustion chamber 11, air will enter the second air passage 52 between the bottom wall of the first furnace body unit 101 and the bottom wall of the second furnace body unit 102 through the air inlet 3, and then enter the combustion chamber 11 through the opening 1021 in the bottom wall of the second furnace body unit 102.

Figure 6:
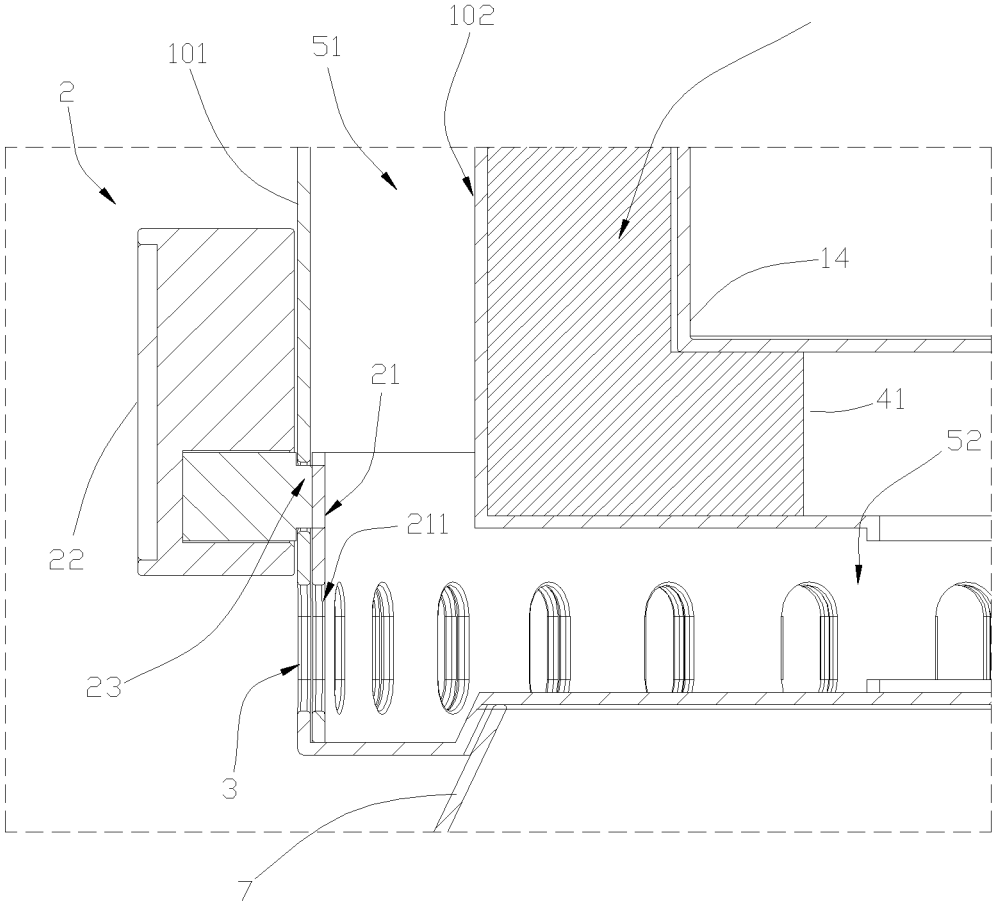
FIG. 6 show a partial enlarged diagram at B.
Figure 7:
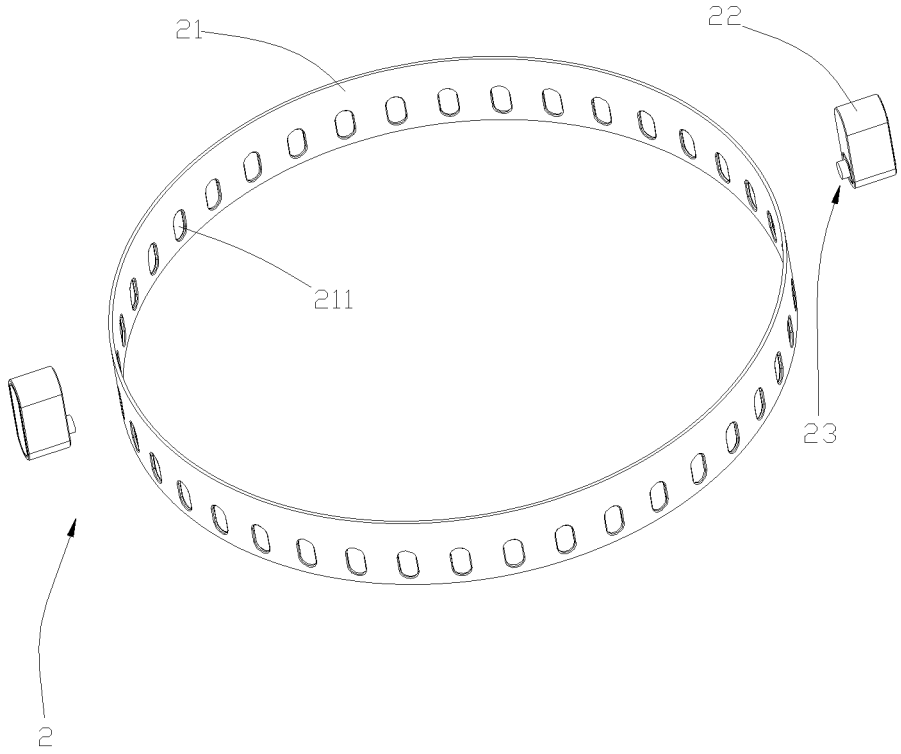
FIG. 7 shows an explosive diagram of an adjusting mechanism according to Embodiment 1.
Figure 8:
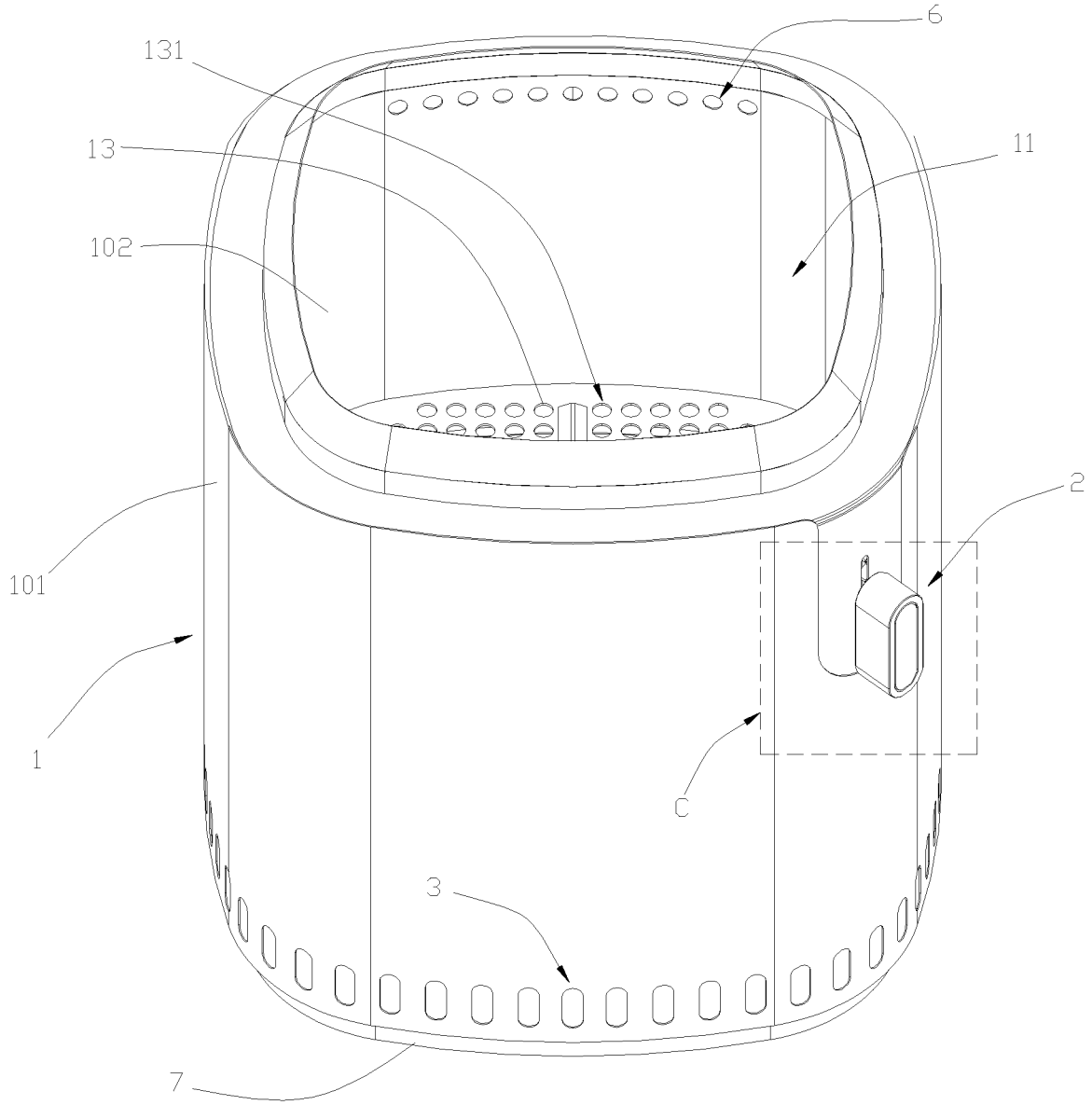
FIG. 8 shows a perspective diagram of a combustion furnace according to Embodiment 2.
Figure 9:
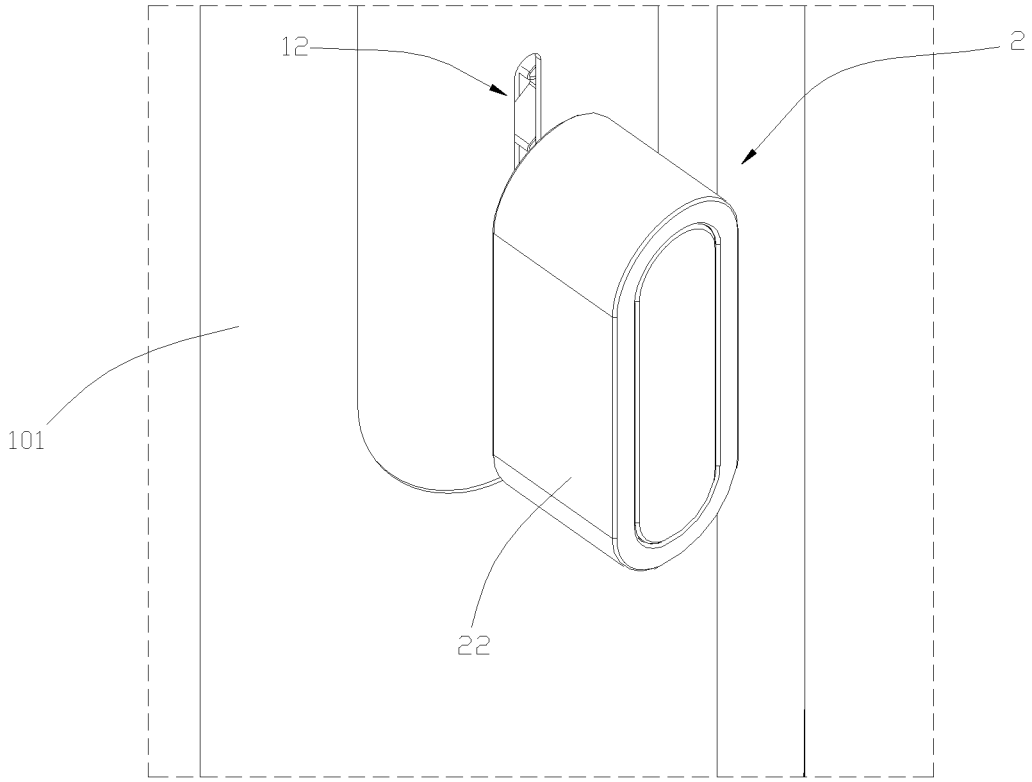
FIG. 9 shows a partial enlarged diagram at C, in which a hand-held part is positioned below a sliding groove.
Figure 10:
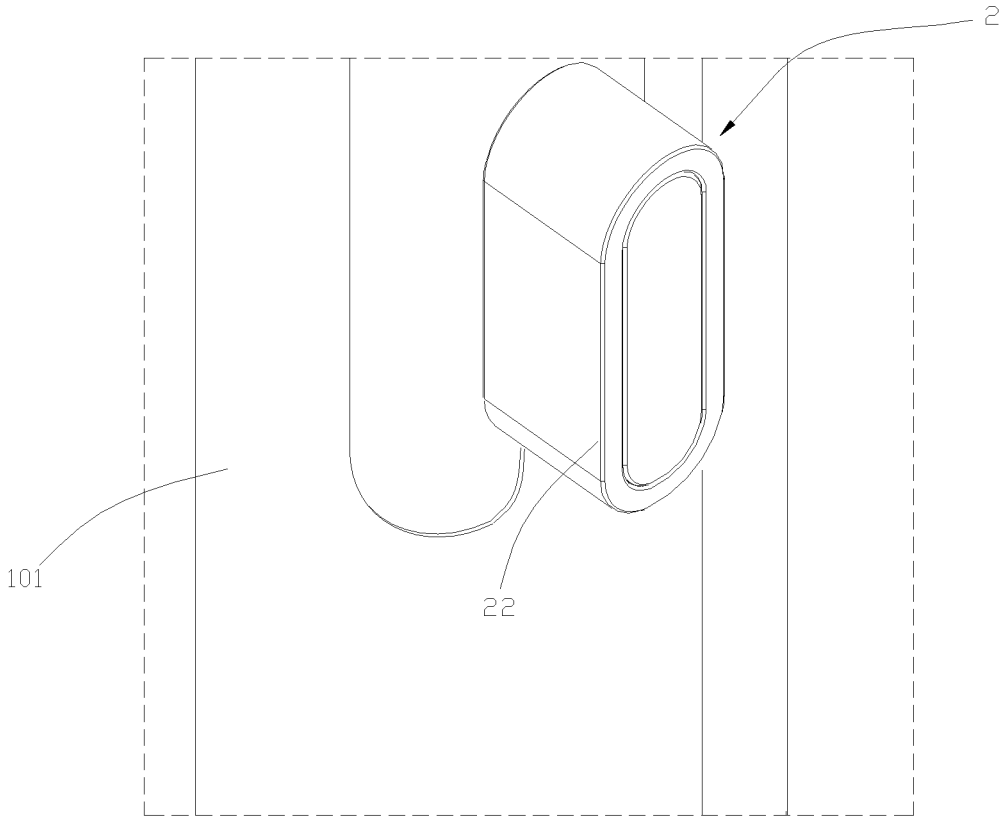
FIG. 10 shows a schematic diagram of a hand-held part positioned above a sliding groove.

Further, as shown in FIGS. 5 and 6, in this embodiment, the baffle 21 is provided at the bottom of the first furnace body unit 101 and closely clings to the first furnace body unit 101, and the sliding groove 12 is correspondingly provided on the side wall of the first furnace body unit 101. When the hand-held part 22 is pushed, the baffle 21 will rotate with respect to the first furnace body unit 101.

Further, in this embodiment, the combustion chamber 11 forms an upper chamber 112 above the combustion rack 13. The side wall of the upper chamber 112 is surrounded by an air outlet 6. Air can enter the first air passage 51 through the air inlet 3 and then enter the upper chamber 112 through the air outlet 6. The air entering the upper chamber 112 can further burn the smoke in the upper chamber 112.

Further, the combustion furnace of this embodiment further includes a base 7. The base 7 is provided below the furnace body 1 for supporting the furnace body 1.

Embodiment 2

As shown in FIG. 8 to FIG. 17, this embodiment provides a combustion furnace with adjustable firepower. The combustion furnace includes a square furnace body 1. The furnace body 1 is provided with a combustion chamber 11 in which other combustible materials such as wood are placed. The combustion chamber 11 forms a port above the furnace body 1, into which wood is put. Further, a plurality of air inlets 3 are provided below the side wall of the furnace body 1. The air inlets 3 are provided around the furnace body 1 and are configured to be communicated with the combustion chamber 11. When wood burns in the combustion chamber 11, air can enter the combustion chamber 11 through the air inlets 3, so that the wood can be fully burned. Further, the combustion furnace of this embodiment is further provided with an adjusting mechanism 2. The adjusting mechanism 2 is configured to control the air inlets 3 to be turned on or off.

Figure 16:
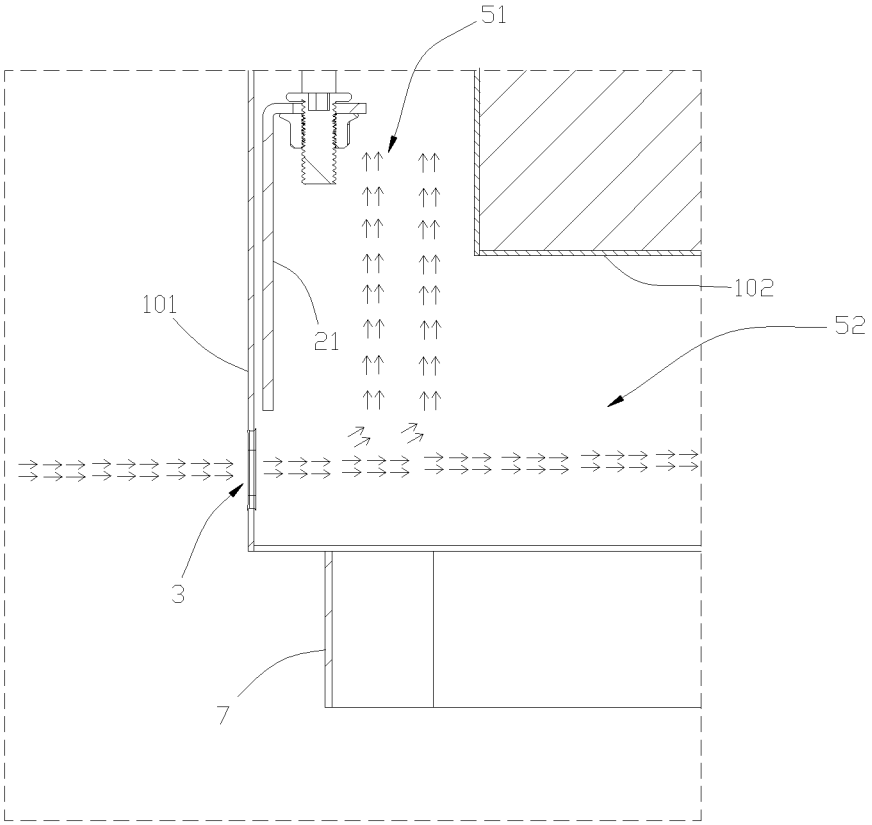
FIG. 16 shows a schematic diagram of an air inlet of FIG. 15 in an OFF state (the arrow in the figure indicates the air flow direction).
Figure 17:
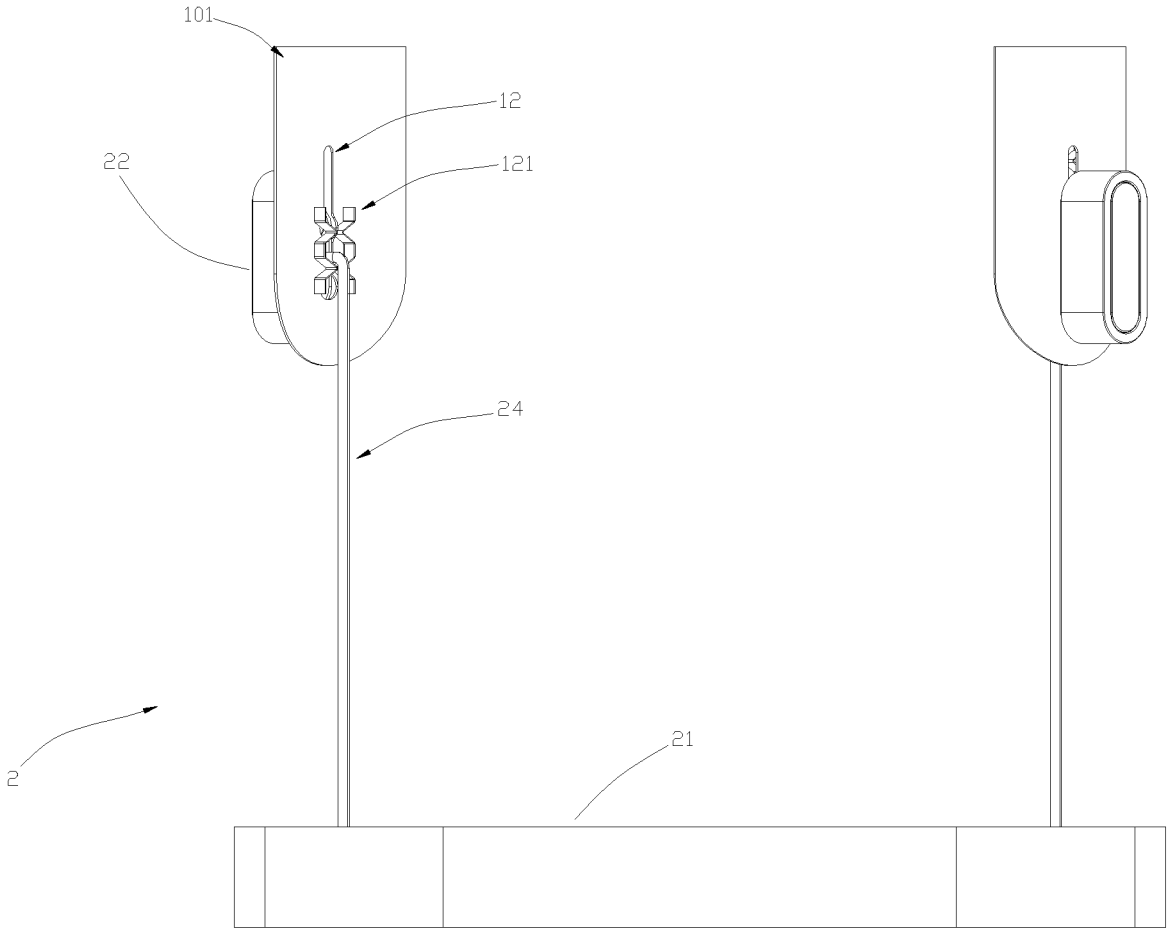
FIG. 17 shows a perspective diagram of an adjusting mechanism according to Embodiment 2.

When in use, users can put the wood into the combustion chamber 11 through the opening 1021 to ignite the wood. When the firepower needs to be increased, the adjusting mechanism 2 can be controlled to turn on the air inlet 3. As shown in FIG. 16, after the air inlet 3 is turned on, oxygen in the combustion chamber 11 is continuously consumed along with the combustion of the wood, so that the external air enters the combustion chamber 11 through the air inlet 3, and the combustion of the wood is stronger. When the firepower needs to be decreased, the adjusting mechanism 2 can be controlled to turn off the air inlet 3. After the air inlet 3 is turned off, the combustion intensity of wood will be gradually weakened along with the continuous consumption of oxygen in the combustion chamber 11, so as to prolong the combustion time of wood. Through the above structural arrangement, users can adjust the firepower of the combustion furnace by controlling the adjusting mechanism 2, so as to meet different requirements. The combustion furnace with adjustable firepower is simple in operation and strong in practicality.

Specifically, the adjusting mechanism 2 of this embodiment includes a baffle 21. The shape of the baffle 21 matches the shape of the furnace body 1. The baffle 21 is provided at the bottom of the side wall of the furnace body and closely clings to the side wall of the furnace body 1 to block the air inlet 3. Further, the baffle 21 can move up and down with respect to the side wall of the furnace body 1 to control the air inlet 3 to be turned on and off.

Through the above structural arrangement, when the firepower needs to be adjusted to the maximum, the baffle 21 can be moved upward to keep the baffle 21 away from the air inlet 3, so as to turn on the air inlet 3 of the furnace body 1. When the firepower needs to be decreased, the baffle 21 can be moved downward to block the air inlet 3, so as to turn off the air inlet 3 of the furnace body 1. The combustion furnace with adjustable firepower is simple in structure and ingenious in design.

Further, the adjusting mechanism 2 of this embodiment further includes a hand-held part 22, a connecting part 23 and a connecting rod 24. The top of the side wall of the furnace body 1 is longitudinally provided with a sliding groove 12. One end of the connecting part 23 is connected with the hand-held part 22, and the other end thereof is connected with one end of the connecting rod 24 through the sliding groove 12. The other end of the connecting rod 24 is connected with the baffle 21.

Through the above structural arrangement, when the baffle 21 needs to be moved upward, the hand-held part 22 can be pushed upward, so that the connecting part 23 translates upward in the sliding groove 12, so as to drive the connecting rod 24 to move upward. The connecting rod 24 moving upward will drive the baffle 21 to move upward in the furnace body 1, so as to turn on the air inlet 3. Similarly, when the baffle 21 needs to be moved downward, the hand-held part 22 can be pushed downward, so that the connecting part 23 translate downward in the sliding groove 12, so as to drive the connecting rod 24 to move downward. The connecting rod 24 moving downward will drive the baffle 21 to move downward in the furnace body 1, so as to turn off the air inlet 3.

Figure 11:
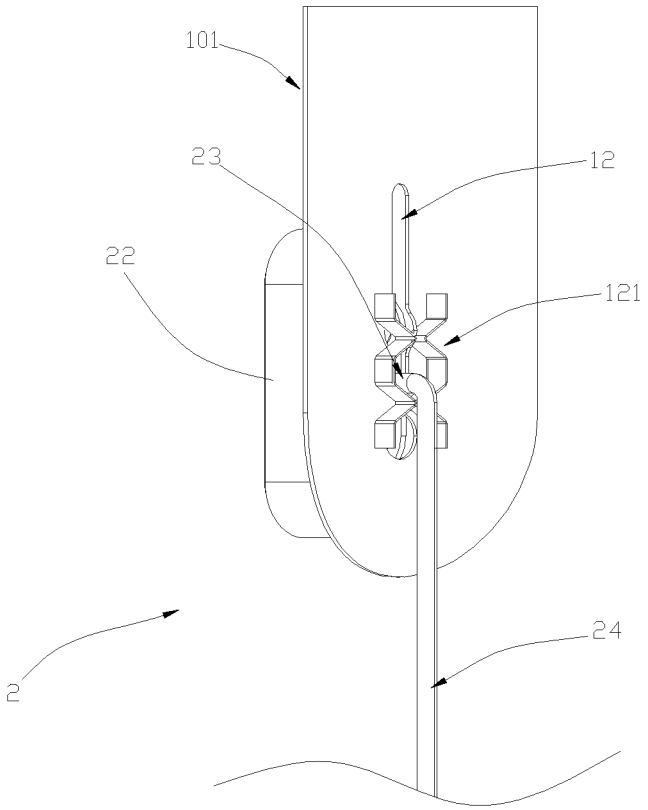
FIG. 11 shows a schematic diagram of a connection relationship between a connecting part and a stopper of FIG. 9.
Figure 12:
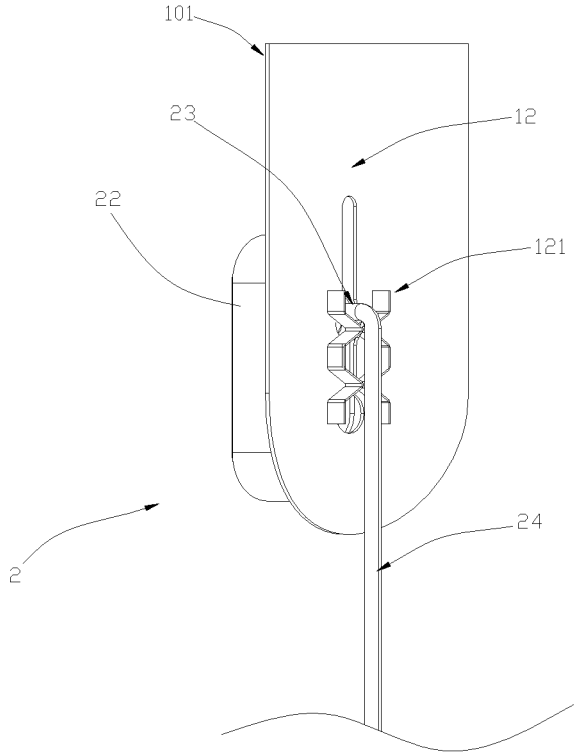
FIG. 12 shows a schematic diagram of a connection relationship between a connecting part and a stopper of FIG. 10.
Figure 13:
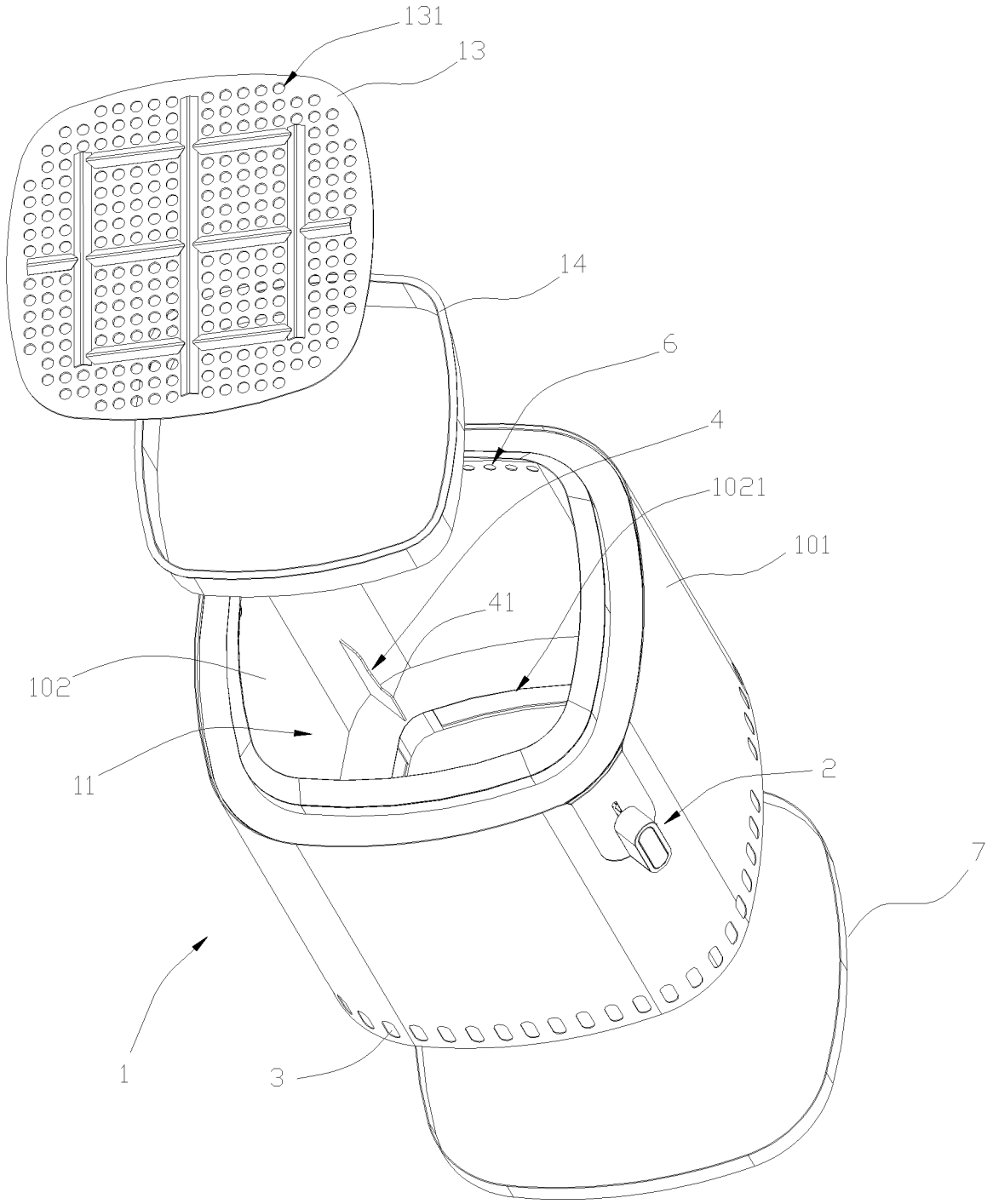
FIG. 13 shows an explosive diagram of a combustion furnace according to Embodiment 2.
Figure 14:
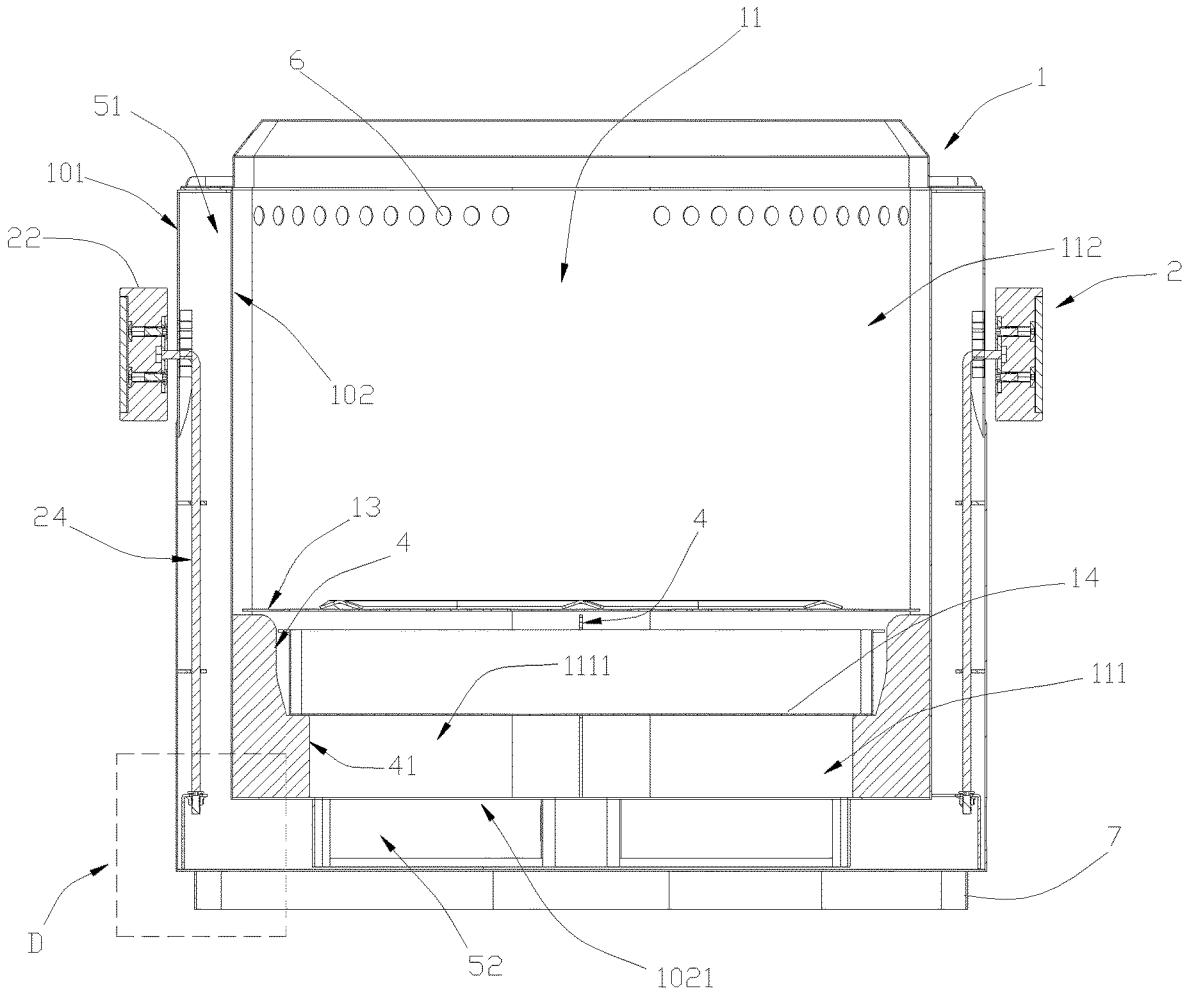
FIG. 14 shows a cross-sectional diagram of a combustion furnace according to Embodiment 2.

Further, in this embodiment, as shown in FIGS. 11 and 12, the furnace body is further provided with a stopper 121 at the sliding groove 12. The stopper 121 is used to fix the connecting part 23 in the sliding part when the connecting part 23 moves in the sliding groove 12.

Further, a combustion rack 13 in which wood is placed is provided in the combustion chamber 11 of this embodiment. The combustion chamber 11 forms a lower chamber 111 below the combustion rack 13. A plurality of wind shields 4 are provided in the lower chamber 111 to divide the lower chamber 111 into a plurality of chamber units 1111. The combustion rack 13 can be erected on the top of the wind shields 4.

Through the above structural arrangement, when air enters the lower chamber 111 from the air inlet 3 at the bottom of the furnace body 1, air will enter different chamber units 1111, so as to prevent air from forming cyclone turbulence in the lower chamber 111 and improve the combustion efficiency of wood.

Further, a storage rack 14 is further provided in the furnace body 1 of this embodiment. The storage rack 14 is provided below the combustion rack 13, and the combustion rack 13 is provided with a plurality of through-holes 131. As an embodiment, the bottom of the wind shield 4 is provided with a protrusion 41. The storage rack 14 can be erected on the protrusion 41. Through the above structural arrangement, when the wood burns to form ashes, the ashes will fall into the storage rack 14 through the through-holes 131, which is convenient for storage and cleaning.

Further, the furnace body 1 of this embodiment includes a first furnace body unit 101 and a second furnace body unit

102. The second furnace body unit is provided in the first furnace body unit 101. Specifically, in this embodiment, the air inlet 3 is provided at the bottom of the side wall of the first furnace body unit 101. The combustion chamber 11 is provided in the second furnace body unit 102. The diameter of the first furnace body unit 101 is longer than that of the second furnace body unit 102. The bottom wall of the second furnace body unit 102 is higher than the bottom wall of the first furnace body unit 101 to form a first air passage 51 between the side wall of the second furnace body unit 102 and the side wall of the first furnace body unit 101, and form a second air passage 52 between the bottom wall of the first furnace body unit 101 and the bottom wall of the second furnace body unit 102. Further, the bottom wall of the second furnace body unit 102 is provided with an opening 1021 to realize the communication between the combustion chamber 11 and the second air passage 52.

With the above structural arrangement, when wood burns in the combustion chamber 11, air will enter the second air passage 52 between the bottom wall of the first furnace body unit 101 and the bottom wall of the second furnace body unit 102 through the air inlet 3, and then enter the combustion chamber 11 through the opening 1021 in the bottom wall of the second furnace body unit 102.

Figure 15:
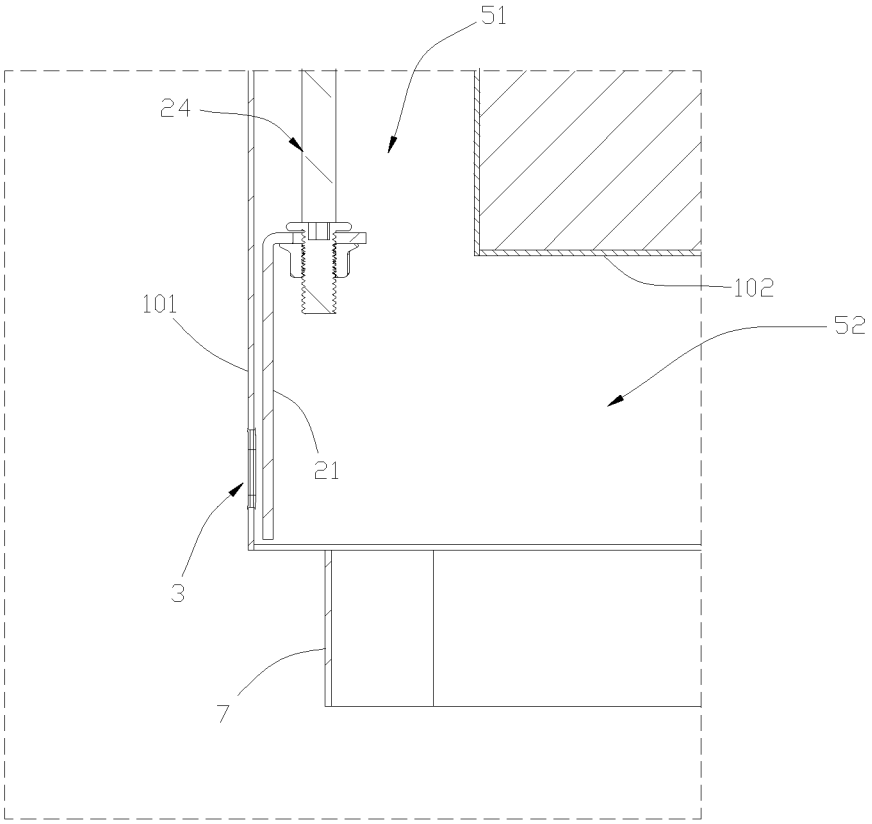
FIG. 15 shows a partial enlarged diagram at D, in which an air inlet is in an ON state.

Further, as shown in FIGS. 15 and 16, in this embodiment, the baffle 21 is provided at the bottom of the first furnace body unit 101 and closely clings to the first furnace body unit 101, and the sliding groove 12 is correspondingly provided on the side wall of the first furnace body unit 101. When the hand-held part 22 is pushed, the baffle 21 will move up and down with respect to the first furnace body unit 101.

Further, in this embodiment, the combustion chamber 11 forms an upper chamber 112 above the combustion rack 13. The side wall of the upper chamber 112 is surrounded by an air outlet 6. Air can enter the first air passage 51 through the air inlet 3 and then enter the upper chamber 112 through the air outlet 6. The air entering the upper chamber 112 can further burn the smoke in the upper chamber 112.

Further, the combustion furnace of this embodiment further includes a base 7. The base 7 is provided below the furnace body 1 for supporting the furnace body 1.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A combustion furnace with adjustable firepower, comprising a furnace body, the furnace body provided with a combustion chamber in which combustible materials are placed, the furnace body further comprising a baffle and an air inlet, the air inlet provided on a side wall of the furnace body, the air inlet communicated with the combustion chamber so that external air enters the combustion chamber through the air inlet, wherein the baffle is controlled to turn on the air inlet to increase firepower of the combustible materials and the baffle is controlled to turn off the air inlet to decrease the firepower of the combustible materials, a combustion rack in which combustible materials are placed is provided in the combustion chamber, the combustion chamber forms a lower chamber below the combustion rack, a plurality of wind shields are provided in the lower chamber to divide the lower chamber into a plurality of chamber units, and the combustion rack is erected on the top of the wind shields, wherein the plurality of wind shields are connected to an inner side surface of the lower chamber, each wind shield comprises a connection portion connected to the inner side surface and an extending portion connected to a bottom of the connection portion, a top of the connection portion is configured to support the combustion rack, the extending portion comprises a main supporting edge and a connection edge, the connection is connected to between the main supporting edge and a side edge of the connection portion, the main supporting edge is configured to support a storage rack, the connection edge and the side edge are configured to limit the storage rack, an intersection angle between the main supporting edge and the connection edge is an obtuse angle, and an intersection angle between the connection edge and the side edge is an obtuse angle.

* * * * *